US006468000B2

(12) United States Patent
McNally et al.

(10) Patent No.: US 6,468,000 B2
(45) Date of Patent: Oct. 22, 2002

(54) METHOD AND APPARATUS FOR FEEDING A TUNNEL ROOF SUPPORT SYSTEM FROM THE ROOF SHIELD OF A TBM

(75) Inventors: Michael P. McNally, Freelton (CA); Christopher McNally, Carlisle (CA)

(73) Assignee: C & M McNally Engineering Corp., Burlington (CA)

( * ) Notice: Subject to any disclaimer, the term of this patent is extended or adjusted under 35 U.S.C. 154(b) by 0 days.

(21) Appl. No.: 09/493,283

(22) Filed: Jan. 28, 2000

(65) Prior Publication Data

US 2002/0098043 A1 Jul. 25, 2002

Related U.S. Application Data

(60) Provisional application No. 60/122,802, filed on Mar. 3, 1999.

(51) Int. Cl.[7] ..... E21D 11/00
(52) U.S. Cl. ..... 405/150.1; 405/146
(58) Field of Search ..... 405/141, 138, 405/150.1, 146; 299/33, 11; 52/506.01, 506.05

(56) References Cited

U.S. PATENT DOCUMENTS 3,640,077 A * 2/1972 Watson et al. ..... 61/42
3,870,368 A * 3/1975 Winberg et al. ..... 299/31
3,903,707 A * 9/1975 Foik ..... 61/85
3,989,302 A * 11/1976 Arrington ..... 299/11
4,120,165 A 10/1978 Stuckmann et al.
4,196,935 A 4/1980 Dring
4,305,683 A * 12/1981 Wagner et al. ..... 405/132
4,355,924 A 10/1982 Hüsemann et al.
4,834,580 A * 5/1989 Barendsen et al. ..... 405/138
5,113,632 A * 5/1992 Hanson ..... 52/385
5,135,326 A * 8/1992 Mitani et al. ..... 405/143
5,203,614 A * 4/1993 Robbins et al. ..... 299/33
5,221,160 A * 6/1993 Azuma et al. ..... 405/138
5,435,669 A * 7/1995 Weber ..... 405/284
5,645,375 A * 7/1997 Stephens ..... 405/146

* cited by examiner

*Primary Examiner*—Robert E. Pezzuto
*Assistant Examiner*—Raymond W Addie
(74) *Attorney, Agent, or Firm*—Edward H. Oldham

(57) ABSTRACT

A primary support for a tunnel roof comprising elongated lagging members which are "extruded" from tubes forming a shield for a tunnel boring machine. The lagging is inserted into the tubes at different times so as to avoid having the ends of adjacent lagging members coincide. As the tunneling machine progresses in the direction of boring, the lagging members emerge from the shield tubes to form a primary tunnel roof lining. Ring beams or arc beams may be installed as required by rock bolts or other fastening devices.

8 Claims, 4 Drawing Sheets

METHOD AND APPARATUS FOR FEEDING A TUNNEL ROOF SUPPORT SYSTEM FROM THE ROOF SHIELD OF A TBM

This application claims benefit of Ser. No. 60/122,802, filed Mar. 3, 1999

BACKGROUND OF THE INVENTION

This invention relation to a system for progressively placing the roof structure in place as the tunnel is being bored with a tunnel boring machine (TBM). This invention will be found to be most effectively used on open or main beam type TBM's in situations where a tunnel is being bored in a rock strata wherein the roof is somewhat unstable.

When boring a tunnel in subterranean rock, the TBM's of the present invention utilize a rotating boring head to spall and crush a rockface by exerting pressure on the rockface by means of a series of cutting elements mounted on a rotating boring head.

As the rockface is gradually eroded, the forward portion of the TBM on which the boring wheel is mounted moves ahead while thrusting against a gripper system which is wedged into the previously formed tunnel. The thrust system provides the required force to crush the rock at the rockface.

Because some tunnels must be driven into rock which is unstable or becomes unstable when subjected to the forces exerted on the rockface by the excavation, it is not unusual to have fractures in the strata surrounding the tunnel itself. These fractures produce discrete pieces of rock which can fall into the tunnel opening if they are not held in place after the TBM moves forward.

If the fractures occur in the bottom or sides of the tunnel, it is of little consequence. However, if the strata through which the tunnel is being bored is of the right type and consistency, rock fractures occurring in the tunnel roof may allow portions of the roof to fall which can have serious consequences for the tunneling operation. Falling rock from the tunnel roof may endanger tunnel workers and the tunneling machinery but the falling rock creates an uncontrolled opening above the tunnel and generally disrupts the excavation process.

Some TBM's have employed a shield in the form of a partial cylinder which fits close to the most recently formed tunnel roof just behind the boring head of the TBM. The shield is sometimes provided with some means or other to move the shield vertically so as to be able to engage or remain clear of the tunnel roof. The shield provides the protective structure to prevent falling rock from injuring TBM operating personnel but does not provide a permanent support for the tunnel roof. As the shield moves forward with the TBM, it uncovers the tunnel roof which if not otherwise supported, can fall.

It is not unusual to encounter conditions where falling rock from the roof of a newly formed tunnel can present such a hazardous situation that the boring operation must be halted while a temporary roof is placed in the newly formed tunnel. Arc shaped cylindrical segments of a suitable material (usually steel) may be bolted to the roof by rock bolts. If the TBM shield has a fingered shield which will permit the installation of rock bolts between the shield fingers, metallic roof ribs may be fastened to the roof of the tunnel while the shield is yet above the rib. Of course, the exposed ends of the rock bolts which protrude between the fingers of the TBM shield may present a problem if for some reason the fingers of the TBM shield move laterally, as may well happen during a steering correction operation of the TBM. Rib systems placed with finger shields, though providing support for the tunnel roof at periodic spaced intervals, has the shortcoming of not providing support for the tunnel roof between the placed ribs. Because of the shape of the shield and its extending fingers, a large proportion of the tunnel roof is obscured by the extending fingers and if an attempt is made to install timbers etc. between the fingers of the shield, the previously installed rock bolts prevent the insertion of such roof support members between the extending shield fingers.

At times wire mesh (similar to chain link fence or concrete reinforcing mesh) has been used between the roof ribs and the fingers of the shield to prevent rock fall from the exposed portion of the tunnel roof between the shield and the roof rib, but this method of support suffers from the lack of rigidity of the mesh between the shield and the last installed rib. The mesh tends to sag as rock drops from the roof; this sagging mesh not only protrudes into the tunnel destroying the tunnel profile, but serious deterioration of the roof may occur above the mesh.

Before applicants' instant invention, the only effective method previously known for the installation of longitudinally extending support members between the roof ribs was to install such members after the finger shield had moved onward away from the ribs and exposed the whole roof.

However, if loose roof rock is present above the finger shield, it will usually fall before or during installation of the longitudinal support members. The potential for falling rock endangers personnel and hinders the construction process.

When boring through other types of strata, problems relating to falling debris from the roof of the tunnel may occur due to the disturbance caused by the TBM's boring activity and this invention may be efficiently employed to provide a safe environment for the tunneling personnel who must perform operations in the tunnel to bring the tunnel construction to completion.

SUMMARY OF THE INVENTION

The TBM of this invention is provided with a shield which comprises a series of hollow rectangular tubes arranged in an arc (akin to slats in a lobster trap) which are fastened together and mounted on a framework of curved beams so as to extend longitudinally along the tunnel axis and have substantially the same surface curvature as the tunnel roof. The tubes extend from a point immediately behind the TBM boring head to a point where the support of the tunnel roof is completed.

The framework is attached to the TBM in such a manner that the curved upper surface formed by the tubes forming the shield may be held against the tunnel roof. The height of the shield is adjustable within predetermined limits.

The tubes forming the shield are of a length required to extend from a point just behind the cutter head to a support installation point and are of such size as to accommodate the elongated members which will provide the primary tunnel roof lining. Thus, the "shield" comprising a plurality of hollow tubes is "loaded" preferably with timber members, such that the ends of the timber pieces protrude from the hollow tubes behind the shield so that they may be fastened by some means or other to the tunnel roof. The tubes are intentionally made to be somewhat larger in cross section than the timber lagging members which are inserted inside the tubes so that the lagging timbers enjoy a "sloppy" fit.

As the boring machine moves into the rock, more of the timber members are exposed almost as if in an extrusion operation. Metallic or other curved or ring support beams may be subsequently installed by the tunnel building personnel as the machine moves away from the last installed roof beam.

The ends of the timber lagging members are intentionally staggered lengthwise along the tunnel roof, so that at no time does a pair of coincident joints occur in adjacent rows at the lagging members. Each time a tube is emptied of its lagging timber, a new lagging timber is pushed into the empty tube to be subsequently fed out as the TBM advances. This causes staggered laps in the timber lagging members forming the completed roof.

PERTINENT PRIOR ART

U.S. Pat. No. 3,989,302 issued Nov. 2, 1976.

This patent describes a TBM having a shield comprising a series of "T" shaped members mounted on a curved beam structure. Lagging members are installed between the T shaped members such as 58, 59 and the supporting beams such as 30 and 31.

The lagging members (17, 48, etc.) are installed in the space between support beams 30, 31 and the T shaped members of the shield by lowering the support beams 30, 31 by means of cylinder actuators 36, 37 to provide the necessary space to insert lagging members 17, 48, etc.

TBM's must be stopped at intervals to permit the "mined" material produced by the boring head to be removed, and it is during this time that the support beams 31, 32 may be lowered to permit the insertion of new lagging members 17, 48, etc. in the space between T members 17, 48, etc. and support beams 30, 31.

If, however, the TBM has moved a sufficient distance that a substantial portion of the tunnel roof has not been lagged due to the progress made in the boring operation, it may be necessary to halt the boring operation to install the lagging members in the shield.

Additionally, once the lagging members 17, 48, etc. have been installed in between the T shaped shield members 58, 59; 60, 61; etc., there is little opportunity to install rock bolts between the T shaped shield members.

After the shield has left the lagging members 17, 48, etc. exposed a support system must be installed to hold the lagging members against the roof.

The patent describes the use of ring beams 23, 24, etc. which are subsequently installed, and wedges such as 79 are used to "jack" the lagging members against the tunnel roof.

Other methods of securing the lagging members 17, 48, etc. to the roof i.e. rock bolts are discussed in the patent but these are almost impossible to install while the TBM shield is between the lagging members and the tunnel roof.

Lastly, the above U.S. Patent makes no suggestion of staggering the joints in the lagging members; all the lagging members have been purposely manufactured to have the same length so as to be supported at each end by ring supports 23, 24, etc.

DESCRIPTION OF THE PREFERRED EMBODIMENT

Figure 1:
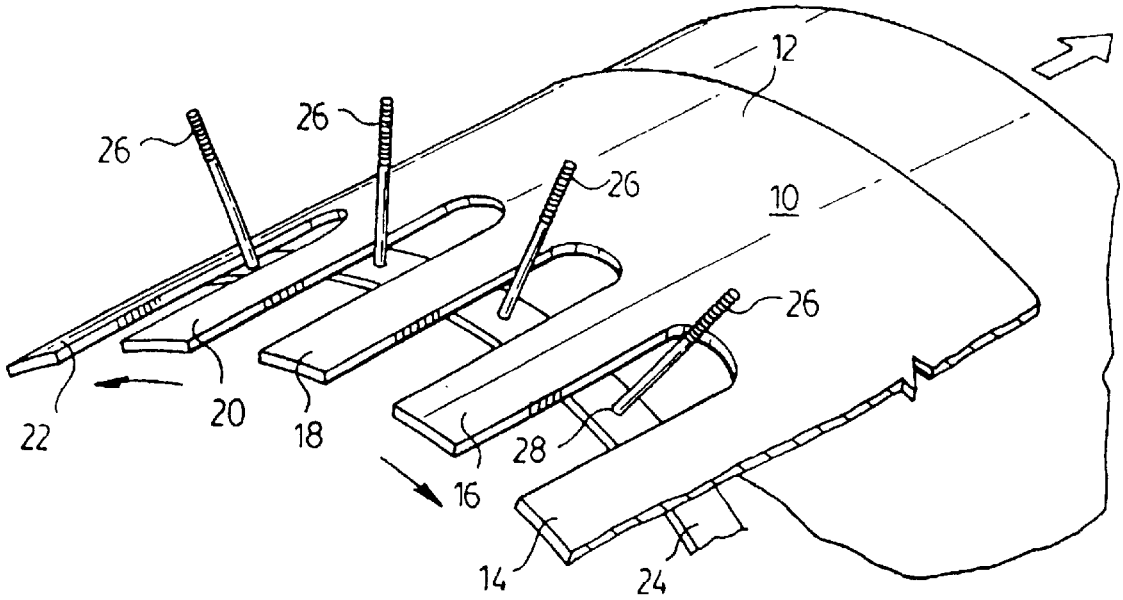
FIG.1. (PRIOR ART)
FIG. 1 is a diagram of a prior art finger shield and associated rock stabilizing apparatus.

FIG. 1 shows a partial view of a TBM shield 10 of the prior art. The shield comprises a steel arch 12 which is attached to the TBM so that the shield may be moved up and down by means of hydraulic cylinders to clear or contact the tunnel roof.

The trailing portion of the shield 10 comprises a series of elongated substantially parallel fingers 14, 16, 18, 20, 22.

Tunnel personnel are able to install an arched rib 24 beneath the shield fingers by means of rock bolts 26 which pass through clearance holes 28 in rib 24 and penetrate deeply into the roof rock. (Note that rock bolts 26 are situated in the only space where it would be desirable to install longitudinal support members.)

As the TBM moves forward, the fingers will gradually pull away from rib 24 and the rib must be drawn up against the tunnel roof to secure any loose rock in place. Ribs such as 24 may have to be installed at frequent intervals in tunnels exhibiting roof instability.

At times during a tunneling operation the finger 14–22 are required to be moved in a lateral direction instead of the axial direction usually followed by the TBM. During such operations, the fingers 14–22 tend to shear the rock bolts 26 or fracture fingers 14–22. This causes substantial inconvenience to the tunnel boring personnel who are responsible for the integrity of the TBM and the roof support structure.

Figure 2:
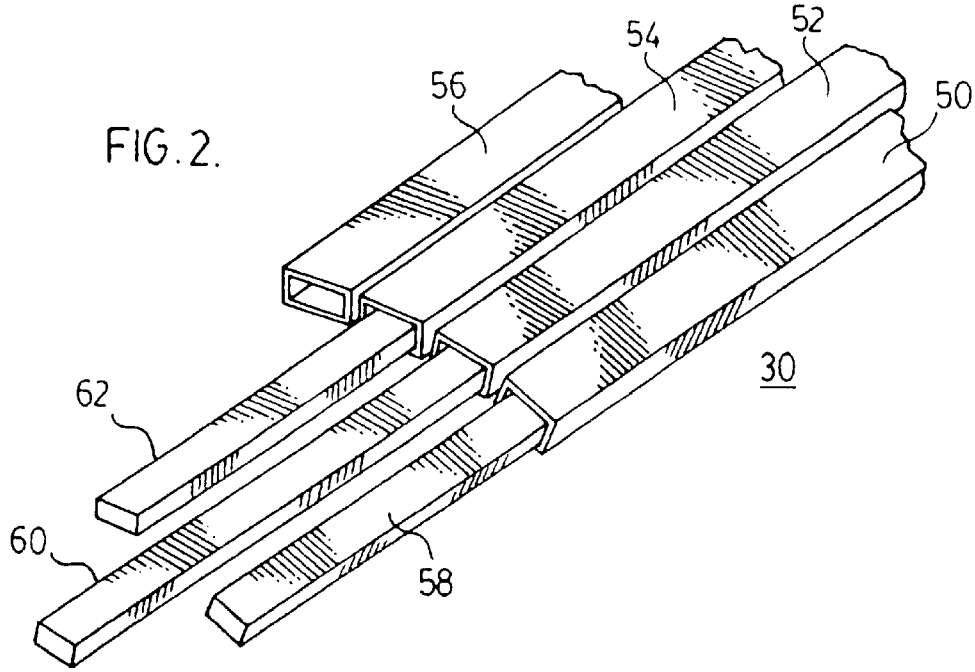
FIG. 2 shows a section of the tubular shield of this invention.

FIG. 2 shows a portion of the novel tunnel shield 30 of this invention. A series of hollow rectangular tubes 50, 52, 54, 56 are mounted on an arched framework on a TBM. Tubes 50, 52 and 54 are shown having lagging members 58, 60, 62 protruding from the interior of tubes 50, 52, etc.

Figure 3:
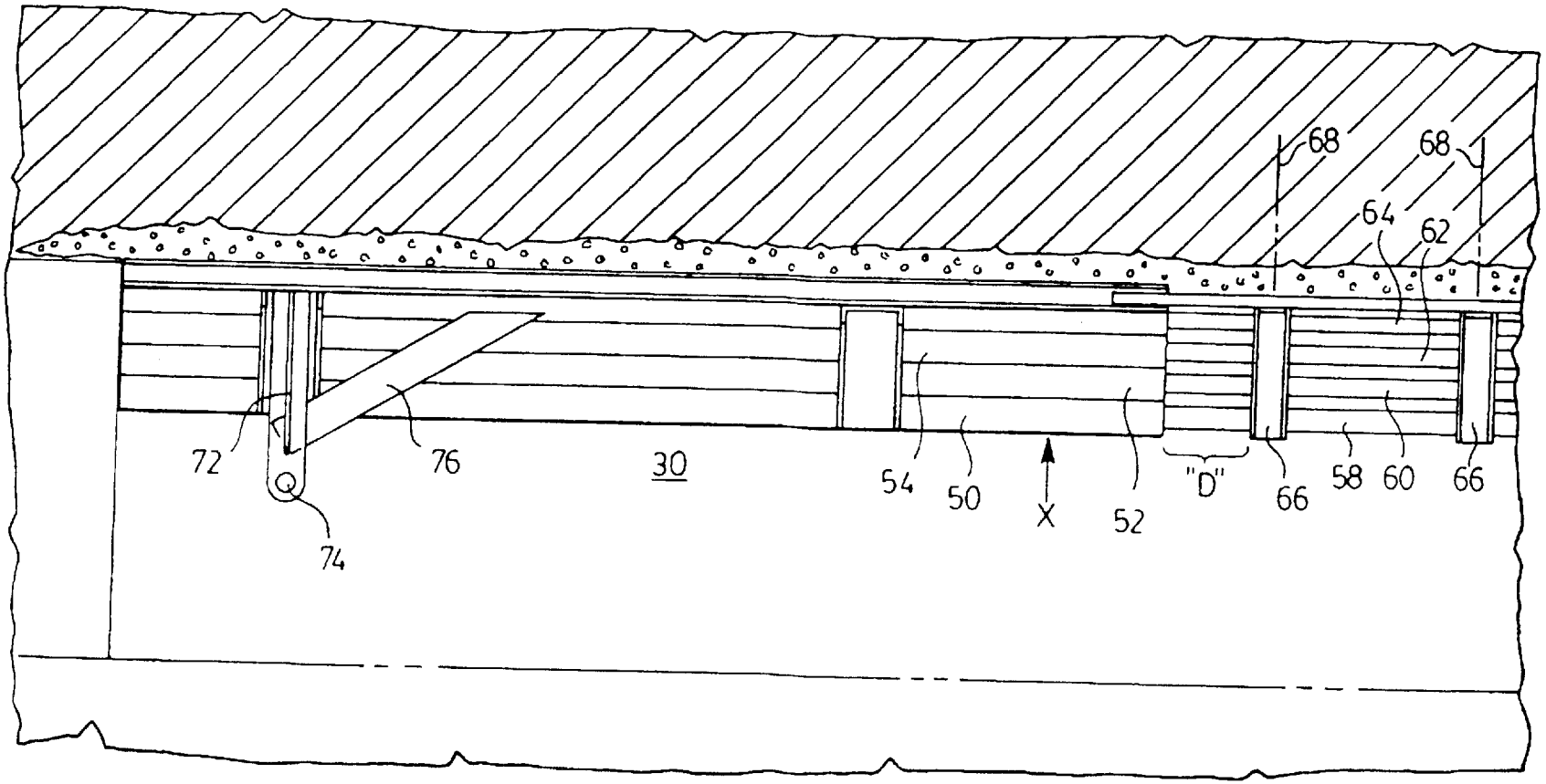
FIG. 3 is a sectional view of tunnel showing the location of the tubular roof shield in the tunnel.

FIG. 3 shows a TBM shield 30 comprising tubular members 50, 52, 54, 56 as partially shown in FIG. 2.

The tubular members are mounted on arched supports 70 on which the tubes are fastened by welding or other suitable fastening means.

Front support 72 is pivoted at pivot 74 and support 76 and provides rigidity to the frame structure carrying the tubes 50–56. An inflatable air bag device is mounted beneath the tubular shield 30 at point "X" to apply a constant upward pressure on shield 40. It is important that pressure device is of a compliant nature so that if the TBM is suddenly jostled by some unexpected force during an excavating operation, the shield 30 may be allowed some freedom to move so as not to bend tubes 50, 52, etc.

Lagging members 58, 60, 62, etc. are shown protruding from tubes 50, 52, 54, etc. and are subsequently fastened to the tunnel roof 80 by means of ribs 66, and roof rock bolts 68. (If full rings are being used to support the lagging members, it may not be necessary to use rock bolts.)

As the lagging members such as 58, 60 and 62 are "extruded" from the rectangular tubes such as 50, 52 and 54, the ribs such as 66 are bolted in place (by use of rock bolts 68) against the lagging members 58, 60, etc. to secure the lagging members firmly against the roof of the tunnel. The tubes 50, 52 and 54 support the lagging members at their forward end; the ribs 66 supply the anchoring mechanism in the area where the tunnel has been driven. A space shown as "D" between the end of the shield of the TBM and rib 66 is bridged by lagging members such as 58, 60 and 62 so that workers may safely work in this area to install ring supports such as 66.

If the TBM should move so that the tubes 50, 52 and 54, etc. move laterally (or rotate about its longitudinal axis), the lagging members 58–62 merely swing from the end of shield 40 and pivot from the last rib installed in the roof.

As the lagging members are fed out of the tubes, such as 50–54, they must be replenished in the rectangular tubes 50–54. Usually, the lagging members are interspersed in such a manner that the joints are staggered along the mine roof. Thus, periodically a new lagging member must be installed in the tubes of the shield, and this may be done while the TBM is operating; it is not necessary to lower the shield to insert a new lagging member. It may be convenient to overlap the ends of the lagging members at the joint.

Figure 4:
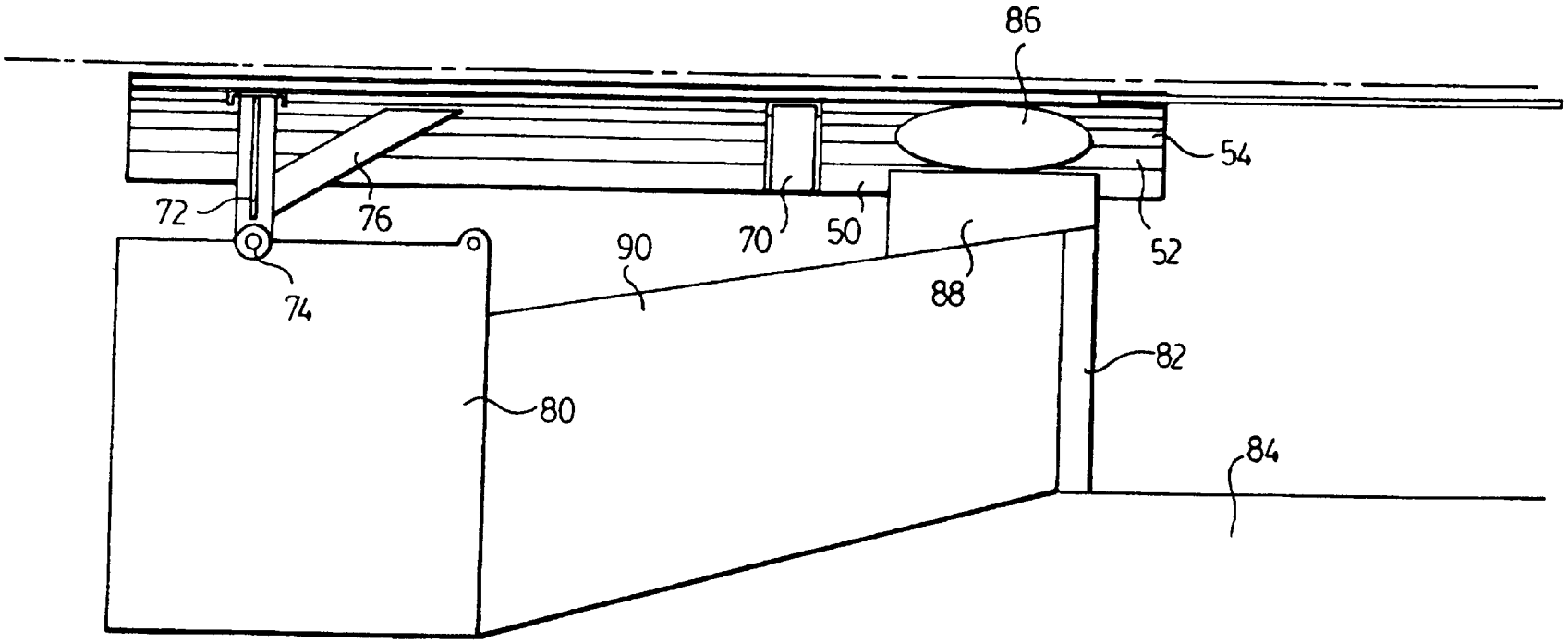
FIG. 4 shows a similar structure to FIG. 3 but includes part of the tunnel boring machine.

FIG. 4 shows a similar view to that shown in FIG. 3 except that parts of the TBM are present in FIG. 4. Front support lugs 80 used to support the forward portion of the roof shield 30 are shown. Rear support 82 is supported from the main beam 84 of the TM. A plateau is formed at 86 by member 88 which is supported by member 82 and intermediate support 90.

The airbag 92 provides a resilient support for the rearmost portion of shield 30 and is easily adjusted to suit the condition existing at the boring site in the tunnel. The presence of the air bag 92 supplies the upward force necessary for holding shield 30 against the roof of the tunnel.

Figure 5:
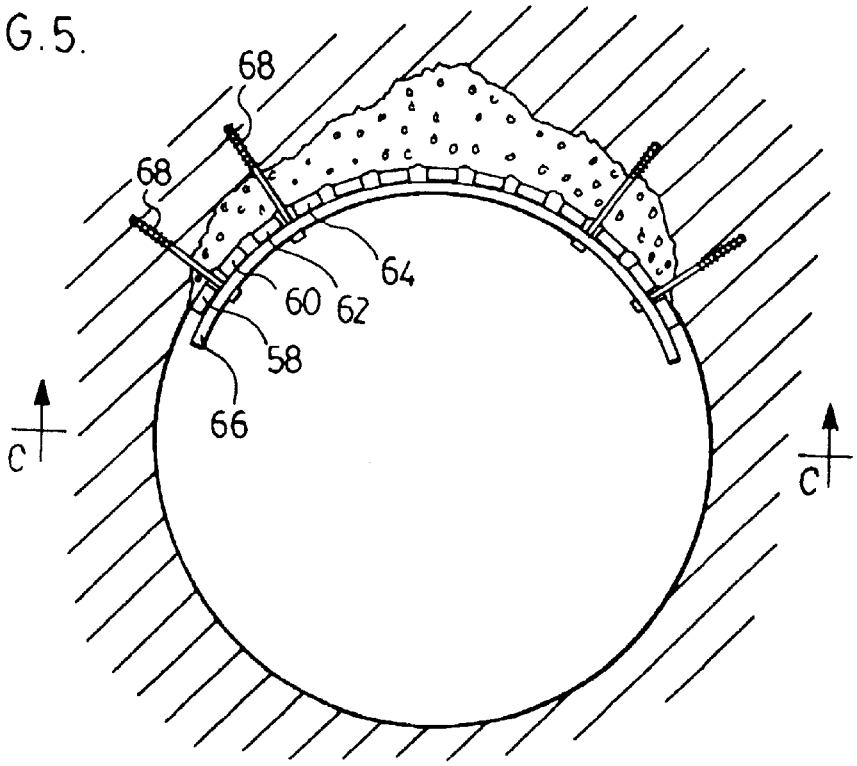
FIG. 5 is a sectional view of the tunnel having lagging installed.

FIG. 5 shows a cross section of tunnel which has had a lining installed during a tunneling operation. Bolts 68 secure arch support member 66 in place to hold the lagging members such as 50–54 against roof 81.

Figure 6:
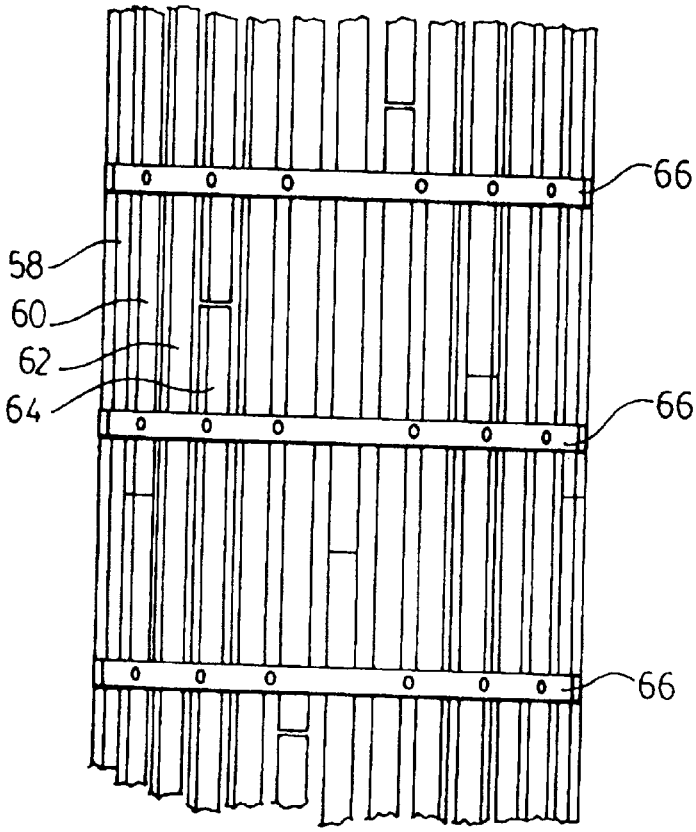
FIG. 6 is a view along section C—C of FIG. 5.

FIG. 6 shows a view of the tunnel roof taken along section C—C of FIG. 5. The extruded lagging members such as 50–54 are all permanently located under ribs 66 held firmly by rock bolts such as 68.

The advantages of applicant's device are many.

There is no need to install rock bolts in the area of the shield (as shown in FIG. 1) because the lagging members 50–54 are supported by the tubes 50, 54, at the TBM end of the "bridge" formed between the TBM shield 30 and the latest rib such as 66 installed in the tunnel. Thus, there are no rock bolts to fracture or cause damage to the shield of the machine during any unexpected lateral or twisting motion of the shield 30.

The lagging members are deliberately chosen to be somewhat flexible so as to allow substantial motion of shield 30 without breakage to shield 30 or the lagging members because the lagging members are flexible.

Lagging members may be installed in shield while the TBM is operating.

The ribs are installed against the lagging members 50, 54, etc. at some distance behind the shield of the TBM so that ribs 66 need to be tightened only once against the lagging members 50–54, etc.

The preferred material for lagging is lumber, such as building grade spruce 2"×4", 1"×2", 2"×3" depending on the nature of the fractures occurring in the tunnel roof. In some instances, heavier timbers may be required. The size of timber lagging will depend on the stability of the rock formation and the diameter of the tunnel being bored.

It may be possible to use plastic or steel lagging in tubes which are other than of a rectangular cross section. Those skilled in the art, will immediately know the size of lagging required for a safe and secure primary tunnel lining for the tunneling conditions encountered. This invention functions best when the timber lagging members are given a generous amount of clearance in the hollow tubes of the shield.

This invention will function in most adverse tunneling conditions to protect tunnel personnel and tunnel machinery during tunneling operations. Loose rock that falls on shield 30 is held first by the shield and then by the lagging members 50–54 etc. Rock pieces are prevented from falling on the tunnel workers or the tunneling machinery.

Because of the continuous barrier created by the shield 30 and the lagging members 50–54 etc., consistent excavation of the tunnel results, and productivity gains will result during the tunnel excavation. After the excavation has been completed, it is not unusual to undertake additional work to "line" or "finish" the tunnel. In prior art structures, situations have been encountered where concrete must be pushed upwardly into caverns left by the falling roof rocks.

If a wire mesh has been employed to stabilize the tunnel roof, it may have sagged in areas of roof instability and protrude into the tunnel destroying the circular profile of the tunnel. Considerable time and energy must be expended to remove the "intrusions" before lining of the tunnel takes place.

Problems such as those outlined above are eliminated with the present invention.

Although alternatives will be apparent after reading this specification, the applicant wishes the scope of this invention to be limited only to the breadth of the following claims.

What is claimed is:

1. A roof shield for a tunnel boring machine (TBM) which is mounted on said TBM to prevent tunnel debris from falling on said TBM and TBM operating personnel;

said roof shield comprising a plurality of closely spaced elongated hollow tubes for containment and delivery of lagging members therefrom mounted on a framework of said TBM to conform to the shape of the tunnel;

said tubes extending from the front of said TBM to a predetermined location on said TBM and having openings at said predetermined location on said shield for insertion of and delivery of said lagging members into and out of said roof shield said tubes preventing exposure of said lagging members contained therein to said tunnel roof;

said tubes accommodating lagging members which extend through said openings to be exposed to said tunnel roof beyond the rear of said shield.

2. A roof shield as claimed in claim 1 wherein said tubes and lagging members are rectangular in cross section.

3. A method of stabilizing a roof of a tunnel in which the tunnel roof exhibits instability due to cracking, fracturing and separation of roof fragments in said tunnel roof comprising;

providing a tunnel boring machine (TBM) in a tunnel excavation;

providing said TBM with a roof shield comprising a series of closely spaced elongated tubes having upper surfaces which conform to the surface of said tunnel extending over said TBM, said roof shield having a curved shape to conform to the curvature of said tunnel roof, pressing said shield against said tunnel roof to continuously engage said upper surfaces of said tubes with said tunnel roof to maintain stability of said tunnel roof over said TBM, as said TBM moves in the direction of tunneling, inserting loosely fitting resistibly deflectable lagging members into said hollow tubes of said roof shield from the rear of said shield during a tunneling operation whilst said shield is in contact with said roof;

preventing exposure of said lagging members to said tunnel roof whilst said lagging members are being inserted into and are located inside said hollow tubes, feeding the inserted lagging members from the rear of said shield as said TBM moves forward, so as to expose the protruding ends of the lagging members to said tunnel roof behind said roof shield, securing said protruding lagging members to said tunnel roof at predetermined intervals behind said TBM roof shield.

4. A method of forming a continuous lining of closely spaced lagging members for the roof of a tunnel comprising;

providing a tunnel boring machine (TBM) having a roof shield having storage means and tunnel exposure prevention means incorporated into said roof shield, said roof shield being formed into an arch to conform with said tunnel roof, extending said roof shield over said TBM and maintaining said shield in continuous contact with the roof of said tunnel over said TBM during a tunnel boring operation, inserting lagging members into said storage and tunnel exposure prevention means incorporated into said roof shield as required during a tunneling operation whilst maintaining said roof shield in contact with said tunnel roof, allowing the ends of said lagging members to protrude rearwardly from said roof shield, shielding said lagging members from exposure to said tunnel roof whilst said lagging members are contained in said shield, allowing said lagging members to exit from said roof shield of said TBM in such a manner to cause said lagging members to remain stationary in said tunnel as said TBM moves in the direction of tunneling, periodically installing permanent arch supports underneath said protruding lagging members at a predetermined distance from said roof shield.

5. A method as claimed in claim 4 which includes continually replacing individual lagging members in said roof shield during a tunneling operation as individual lagging members are fed out of said roof shield to maintain a staggered jointed roof structure.

6. A method of constructing a tunnel roof bridge in an area behind a tunnel boring machine (TBM) shield for the use in the construction of a tunnel to prevent tunnel roof debris from falling on persons and equipment working under and behind a TBM comprising:

providing a TBM having a roof shield comprising a series of axially extending substantially parallel hollow receptacles having upper surfaces which conform to the shape of the tunnel roof formed into a roof arch extending a predetermined distance over said TBM so as to be in contact with said tunnel roof as said TBM moves ahead during a tunnel boring operation, inserting lagging members into said receptacles from the rear of said shield as required, maintaining said roof shield in contact with said tunnel roof;

shielding said lagging members from exposure to said tunnel roof where said lagging members are contained in said roof shield, feeding said lagging members out of said shield behind said TBM, supporting said lagging members at one end of said bridge by said roof shield mounted on said TBM and at the other end of said bridge by a supporting rib mounted beneath said lagging members secured to said tunnel roof a predetermined distance behind said TBM.

7. A method of construction a bridge as claimed in claim 6 wherein said receptacles formed in said shield are elongated and extend substantially the length of the TBM.

8. A method for forming a continuous bridge as defined in claim 6 wherein said lagging members comprising said bridge are ultimately supported in said tunnel by ribs installed in said tunnel roof at periodic spaced intervals.

* * * * *